US007287450B1

(12) United States Patent
Liao

(10) Patent No.: US 7,287,450 B1
(45) Date of Patent: Oct. 30, 2007

(54) TOOL DEVICE HAVING ROTATABLE DRIVING SHANK

(76) Inventor: Youn Chyuan Liao, No. 12, Avenue 28, Lane 282, Sec. 2, Situn Road, Situn, Taichung (TW) 40749

( * ) Notice: Subject to any disclaimer, the term of this patent is extended or adjusted under 35 U.S.C. 154(b) by 0 days.

(21) Appl. No.: 11/497,964

(22) Filed: Aug. 2, 2006

(51) Int. Cl.
*B25B 23/00* (2006.01)
*B25G 1/08* (2006.01)
*B25B 23/16* (2006.01)

(52) U.S. Cl. ..... 81/177.9; 81/177.7

(58) Field of Classification Search .... 81/177.5–177.7, 81/177.8, 177.9
See application file for complete search history.

(56) References Cited

U.S. PATENT DOCUMENTS

| | | | | | |
|---|---|---|---|---|---|
| 234,540 | A | * | 11/1880 | Collins | 7/138 |
| 1,215,308 | A | * | 2/1917 | Johnson | 81/436 |
| 1,426,809 | A | * | 8/1922 | Bate | 74/547 |
| 1,776,928 | A | * | 9/1930 | Potts | 81/436 |
| 2,629,415 | A | * | 2/1953 | Baker | 81/58.3 |
| 2,714,409 | A | | 8/1955 | Primrose et al. | |
| 3,773,094 | A | * | 11/1973 | Kuenzel | 81/177.9 |
| 4,848,197 | A | * | 7/1989 | Kikel | 81/440 |
| 4,930,377 | A | | 6/1990 | Lester | 81/15.2 |
| 4,996,896 | A | * | 3/1991 | Bachand et al. | 81/450 |
| 5,069,091 | A | * | 12/1991 | Bramsiepe et al. | 81/177.7 |
| 5,101,696 | A | * | 4/1992 | Neff | 81/177.8 |
| 5,450,775 | A | * | 9/1995 | Kozak | 81/440 |
| 6,397,709 | B1 | * | 6/2002 | Wall | 81/440 |
| 6,401,576 | B1 | * | 6/2002 | Wu | 81/177.4 |
| 6,564,680 | B1 | * | 5/2003 | Rinner et al. | 81/177.5 |
| 7,047,846 | B1 | * | 5/2006 | Hu | 81/177.7 |

* cited by examiner

*Primary Examiner*—David B Thomas
(74) *Attorney, Agent, or Firm*—Charles E. Baxley

(57) ABSTRACT

A tool device includes a handle and a driving shank having one end engaged into the handle and rotatably attached and coupled to the handle with a pivot shaft for allowing the driving shank to be rotated relative to the handle from a straight position in line with the handle to a position perpendicular to the handle to form a T-shaped driving tool device. The driving shank includes a number of depressions and the handle includes a spring biased detent member for engaging with either of the depressions of the driving shank and for anchoring the driving shank to the handle at selected angular positions. An actuating member is slidably received in the handle for actuating the detent member to engage with the driving shank.

15 Claims, 6 Drawing Sheets

TOOL DEVICE HAVING ROTATABLE DRIVING SHANK

BACKGROUND OF THE INVENTION

1. Field of the Invention

The present invention relates to a tool device, and more particularly to a tool device including a driving shank rotatably attached to a handle and rotatable relative to the handle to a straight position in line with the handle to form a typical screw driving tool or rotatable relative to the handle to an inclined position or a perpendicular position relative to the handle to form a T-shaped driving tool for allowing the tool device to be worked in different working positions.

2. Description of the Prior Art

Typical tool devices may comprise a handle and one or more tool elements removable from the handle and attachable to the handle to a position perpendicular to the handle to form a T-shaped driving tool for allowing the driving tool to be effectively rotated or driven by the users.

For example, U.S. Pat. No. 2,714,409 to Primrose et al. discloses one of the typical tool handles comprising one or more tool elements removable from the handle and attachable to a notch of one of the handle members to a position perpendicular to the handle to form a T-shaped driving tool for allowing the driving tool to be effectively rotated or driven by the users.

However, the handle member is required to be formed with the notch to receive the tool elements such that the strength of the handle member will be greatly decreased. In addition, the tool elements may not be solidly secured or attached or coupled to the handle member such that the driving torque of the tool device is weak or small.

U.S. Pat. No. 4,930,377 to Lester discloses another typical tool device comprising one or more tool elements removable from the handle and attachable to a longitudinal bore of a tool receiving flange which is perpendicular to the handle to form a T-shaped driving tool.

However, similarly, the tool elements may not be solidly secured or attached or coupled to the handle member such that the tool elements may have a good chance to be disengaged from the handle member. In addition, the driving torque of the tool device is also weak or small.

The present invention has arisen to mitigate and/or obviate the afore-described disadvantages of the conventional tool devices.

SUMMARY OF THE INVENTION

The primary objective of the present invention is to provide a tool device including a driving shank rotatably attached to a handle and rotatable relative to the handle to a straight position in line with the handle to form a typical screw driving tool or rotatable relative to the handle to an inclined position or a perpendicular position relative to the handle to form a T-shaped driving tool for allowing the tool device to be worked in different working positions.

In accordance with one aspect of the invention, there is provided a tool device comprising a handle and including a chamber formed therein and including a passage formed therein and communicating with the chamber of the handle, and a driving shank including a first end engaged into the handle and rotatably attached and coupled to the handle with a pivot shaft for allowing the driving shank to be rotated relative to the handle, the driving shank is rotated relative to the handle from a straight position in line with the handle to a position perpendicular to the handle to form a T-shaped driving tool device, the driving shank being received in the passage of the handle when the driving shank is in line with the handle.

The driving shank includes a number of depressions formed therein, and the handle includes a spring biased detent member for engaging with either of the depressions of the driving shank and for anchoring the driving shank to the handle at selected angular positions.

The depressions of the driving shank are formed in an outer peripheral portion of the first end of the driving shank. The handle includes a channel formed therein for receiving the first end of the driving shank and includes a conduit formed therein for receiving the spring biased detent member.

The handle includes a pathway formed therein and communicating with the conduit of the handle, an actuating member slidably received in the pathway of the handle and engaged with the spring biased detent member for biasing the spring biased detent member to engage with either of the depressions of the driving shank.

The actuating member includes a recess formed in an outer peripheral portion thereof for receiving the spring biased detent member therein, the recess of the actuating member includes a deeper middle portion for receiving the spring biased detent member and for allowing the detent member to be disengaged from the first end of the driving shank and for allowing the driving shank to be rotated relative to the handle.

The recess of the actuating member includes a shallower actuating portion for engaging with the spring biased detent member and for forcing the spring biased detent member to engage with either of the depressions of the driving shank.

The actuating member includes a bore formed therein and communicating with the recess of the actuating member for forming a slot between the bore and the recess of the actuating member. The handle includes a spring member received in the pathway of the handle for biasing the handle to engage with the detent member.

The spring member includes a biasing segment extendible into the recess of the actuating member through the slot of the actuating member for engaging with the detent member and for forcing the detent member to engage with either of the depressions of the driving shank.

The handle includes an orifice formed therein for receiving the pivot shaft. The handle includes an enclosing cap attached thereto to enclose the orifice of the handle and to shield the pivot shaft.

The handle includes a spring member engaged between the first end of the driving shank and the handle for biasing the driving shank against the handle and for positioning the driving shank to the handle. The handle includes at least one catch extended into the passage of the handle for engaging with the driving shank and for anchoring the driving shank to the handle.

The handle includes at least one latch flap extended from the first end of the handle for partially enclosing the passage of the handle and for retaining the driving shank in the passage of the handle and for allowing the driving shank to be engaged into or out of the passage of the handle.

The handle includes a number of cavities in an end portion for receiving spare tool members therein, and a cover attached onto the handle for enclosing the cavities of the handle and for stably retaining the spare tool members in the cavities of the handle.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 2 is a perspective view illustrating an actuating stem or member of the tool device;

DETAILED DESCRIPTION OF THE PREFERRED EMBODIMENT

Figure 1:
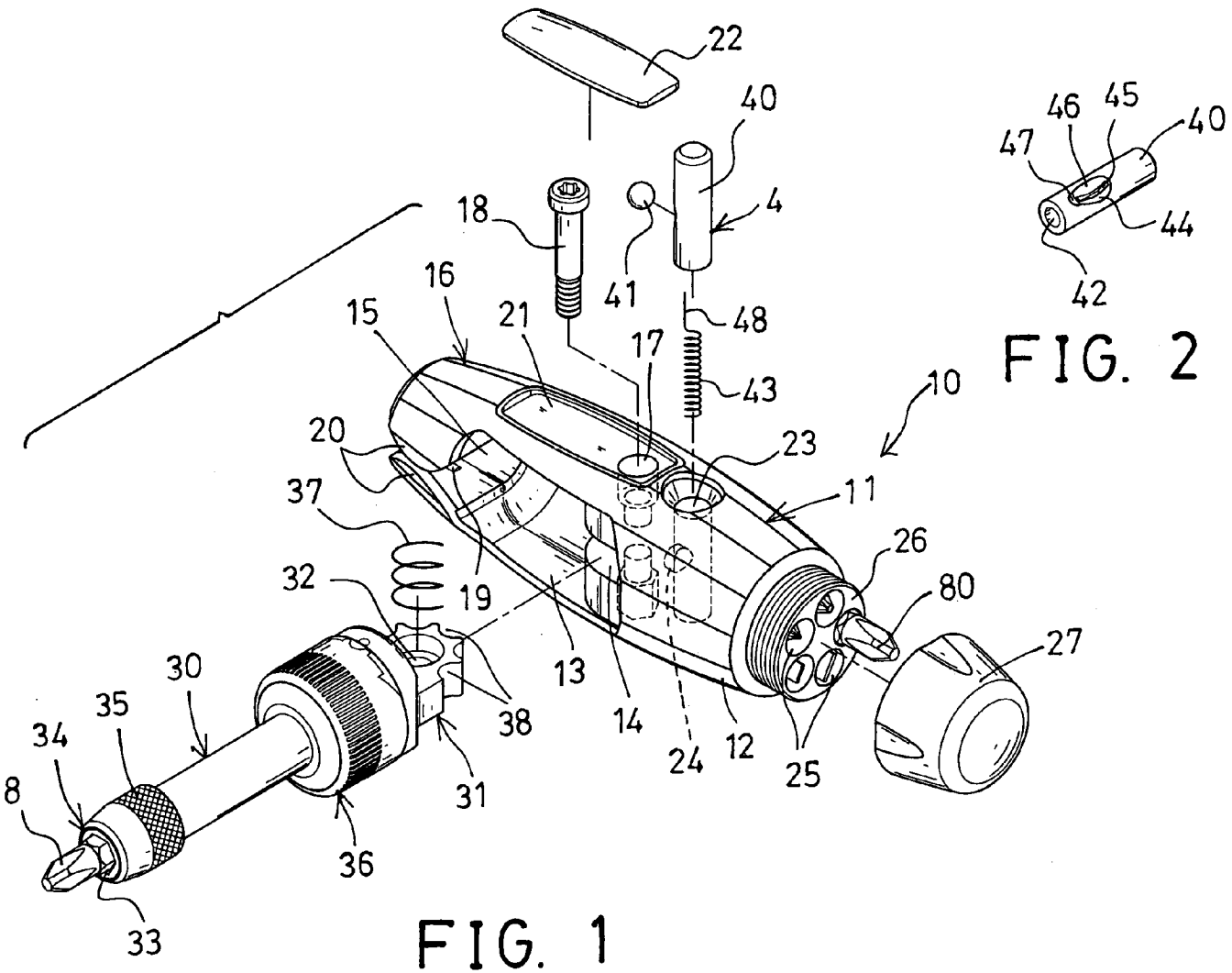
FIG. 1 is a partial exploded view of a tool device in accordance with the present invention.
Figure 3:
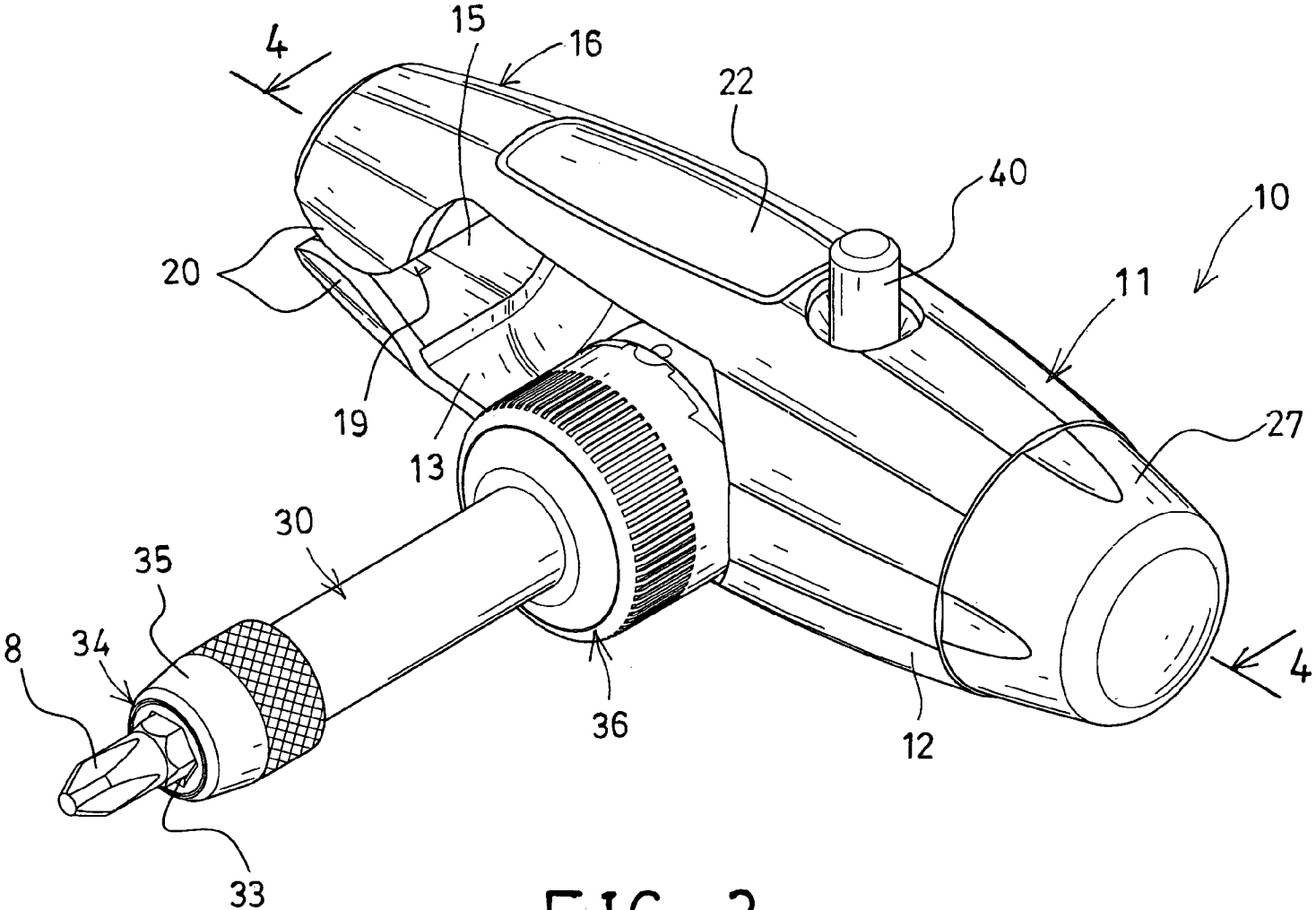
FIG. 3 is a perspective view of the tool device.
Figure 4:
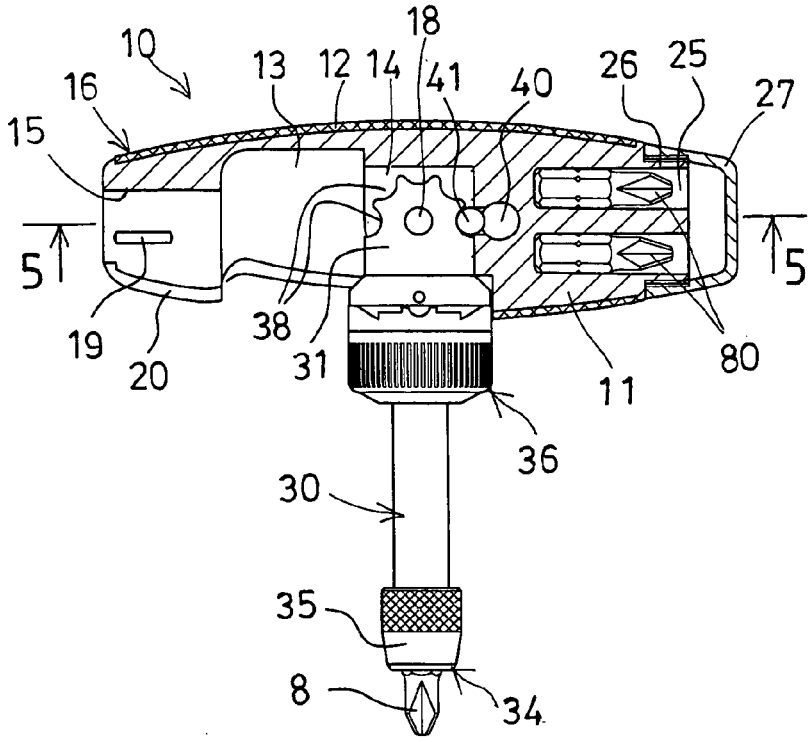
FIG. 4 is a partial cross sectional view of the tool device taken along lines 4-4 of FIG. 3.

Referring to the drawings, and initially to FIGS. 1-5, a tool device 10 in accordance with the present invention comprises a handle 11 preferably including a soft or resilient outer covering 12 attached onto the outer peripheral portion thereof for being softly or comfortably held or grasped by the users, and including a chamber 13 and a channel 14 formed therein, such as formed in the middle portion thereof and communicating with each other, and including a passage 15 formed therein, such as formed in one end 16 of the handle 11 and communicating with the chamber 13 of the handle 11, and including an orifice 17 formed therein, such as formed in the middle portion thereof and intersecting or communicating with the channel 14 of the handle 11 (FIGS. 5, 6) for receiving a pivot shaft 18 therein.

Figure 7:
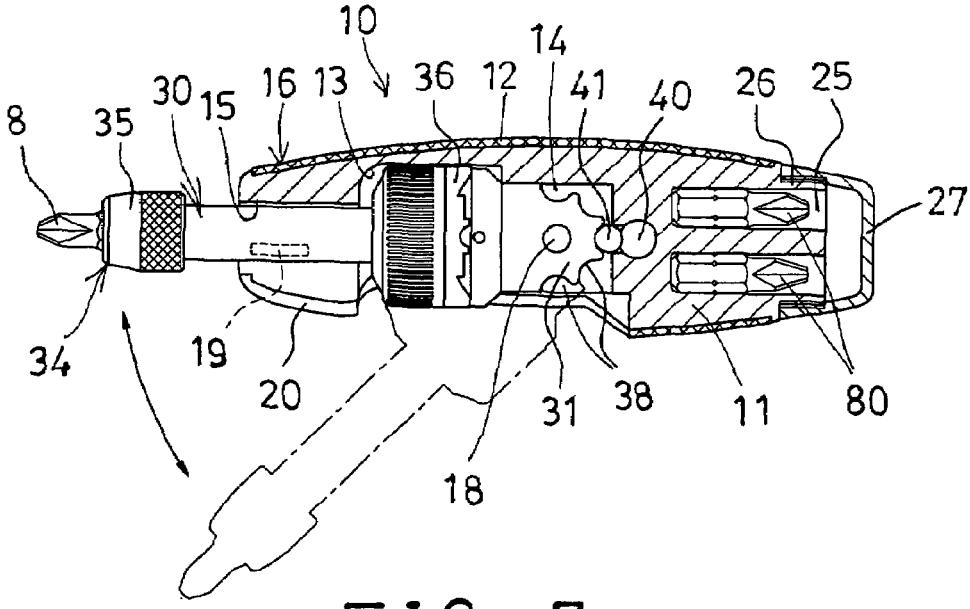
FIG. 7 is a further partial cross sectional view similar to FIG. 4, illustrating the operation of the tool device.
Figure 8:
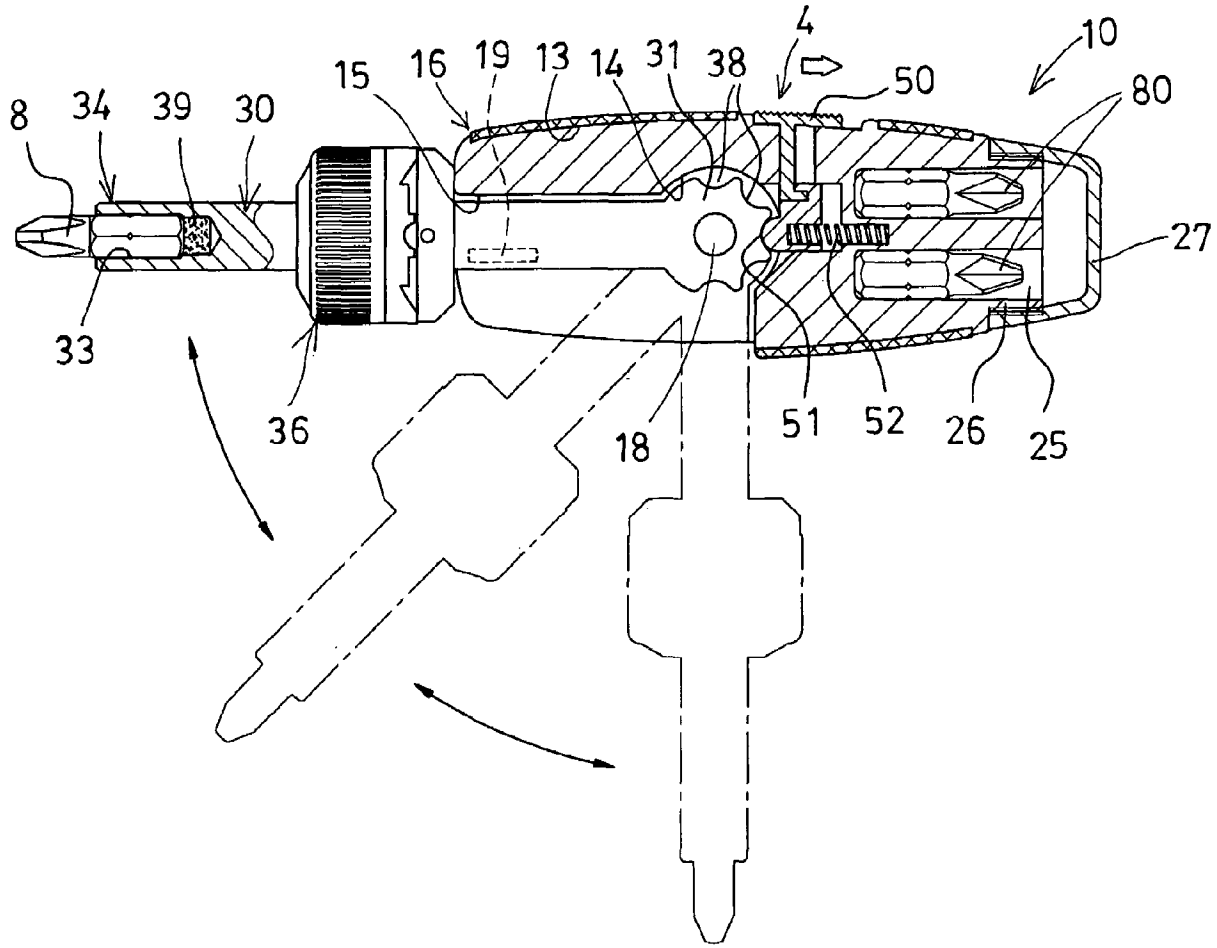
FIG. 8 is a still further partial cross sectional view similar to FIGS. 4 and 7, illustrating the other arrangement of the tool device.
Figure 9:
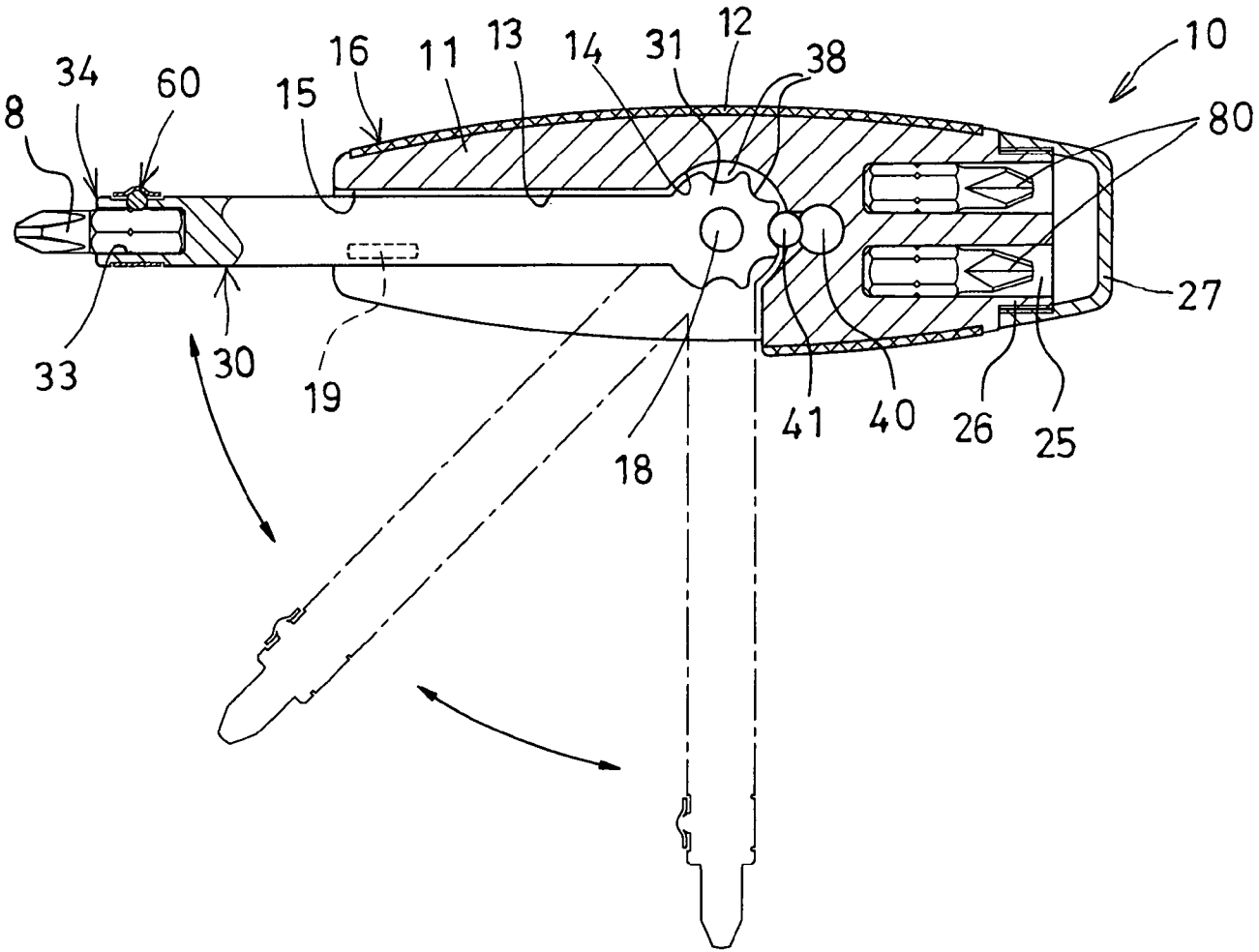
FIG. 9 is a still further partial cross sectional view similar to FIGS. 4 and 7-8, illustrating the further arrangement of the tool device.

A driving shank 30 includes one end 31 engaged into the channel 14 of the handle 11 and having an aperture 32 formed therein for rotatably receiving the pivot shaft 18 and for rotatably attaching or coupling or securing the driving shank 30 to the handle 11 with the pivot shaft 18 and for allowing the driving shank 30 to be rotated relative to the handle 11 to a straight position in line with the handle 11 (FIGS. 7-9) to form a typical screw driving tool, or to be rotated relative to the handle 11 to a position perpendicular to the handle 11 (FIGS. 3-4) to form a T-shaped driving tool, or to be rotated relative to the handle 11 to various inclined positions as shown in dotted lines in FIGS. 7-9, for allowing the tool device 10 to be worked in different working or angular positions.

The driving shank 30 may include a socket opening 33 formed in the other end portion 34 thereof for receiving various tool members 8, such as screw driver bits 8 therein, and a typical quick release coupling device 35 attached onto the other end portion 34 thereof for detachably anchoring or coupling the tool members 8 to the driving shank 30, for allowing the tool members 8 to be suitably rotated or driven by the driving shank 30. A typical ratchet mechanism 36 may be selectively attached onto the one end 31 of the driving shank 30 for controlling the driving direction of the driving shank 30 by the handle 11 and may be selectively engaged into the chamber 13 of the handle 11 when the driving shank 30 is in line with the handle 11. The typical quick release coupling device 35 and the typical ratchet mechanism 36 are not related to the present invention and will not be described in further details.

A spring member 37 may further be provided and engaged between the one end 31 of the driving shank 30 and the handle 11 for biasing the driving shank 30 against the handle 11 and for suitably positioning the driving shank 30 to the handle 11. The driving shank 30 may be rotated relative to the handle 11 to the straight position in line with the handle 11 when the driving shank 30 is engaged into the passage 15 of the handle 11. The handle 11 may include a catch 19 extended into the passage 15 of the handle 11 for engaging with the driving shank 30 and for stably or solidly anchoring or positioning the driving shank 30 to the handle 11 or in line with the handle 11 and for allowing the driving shank 30 to be effectively rotated or driven by the handle 11.

The handle 11 may further include one or more latch flaps 20 extended from the one end 16 of the handle 11 for partially enclosing the passage 15 of the handle 11 and for suitably retaining the driving shank 30 in the passage 15 of the handle 11 and for allowing the driving shank 30 to be selectively engaged into or out of the passage 15 of the handle 11. The handle 11 may further include one or more recesses 21 formed in the outer peripheral portion thereof and intersecting or communicating with the orifice 17 of the handle 11 (FIG. 1) for receiving an enclosing cap 22 therein which may be used to enclose the orifice 17 of the handle 11 and to shield or to protect the pivot shaft 18 and which may be applied with decorative patterns or marks (not shown) or the like thereon.

The driving shank 30 further includes a number of depressions 38 formed in the outer peripheral portion thereof for positioning purposes which will be discuss hereinafter. The handle 11 further includes a pathway 23 formed therein, such as formed in the middle portion thereof and parallel to the orifice 17 of the handle 11 (FIG. 1) for slidably receiving an actuating stem or member 40 or an actuating means or device 4 therein, and includes a conduit 24 formed therein (FIG. 1) and intersecting or communicating with the pathway 23 and the channel 14 of the handle 11 for receiving a detent ball or member 41 which may be engaged with either of the depressions 38 of the driving shank 30.

The actuating member 40 includes a bore 42 formed therein for receiving another spring member 43 therein, and includes a recess 44 formed in the outer peripheral portion thereof and intersecting or communicating with the bore 42 of the actuating member 40 for forming a slot 45 between the bore 42 and the recess 44 of the actuating member 40 (FIG. 2) and for receiving the detent ball or member 41 therein. As also shown in FIG. 2, the recess 44 of the actuating member 40 includes a deeper middle portion 46 for receiving the detent member 41 (FIG. 6) and for allowing the detent member 41 to be selectively disengaged from the one end 31 of the driving shank 30 and thus for allowing the driving shank 30 to be rotated relative to the handle 11 between the straight position in line with the handle 11 and the T-shaped position perpendicular to the handle 11. The spring member 43 is also received in the pathway 23 of the handle 11.

The recess 44 of the actuating member 40 further includes one or more shallower portions 47 formed or provided thereon and acted as an actuating portion 47 for engaging with the detent member 41 (FIG. 5) and for forcing the detent member 41 to engage into or with either of the depressions 38 of the one end 31 of the driving shank 30 and thus for allowing the driving shank 30 to be positioned or secured to the handle 11 at a selected angular position. The spring member 43 includes an end or biasing segment 48 extendible into the recess 44 of the actuating member 40 through the slot 45 of the actuating member 40 for engaging with the detent member 41 and for forcing the detent member 41 to engage into or with either of the depressions 38 of the one end 31 of the driving shank 30 even when the deeper middle portion 46 of the actuating member 40 is aligned with the detent member 41 (FIG. 6). The spring member 43 and the detent member 41 may thus form a spring biased detent member 41 for position or secure or anchor the driving shank 30 to the handle 11 at any selected angular position.

Figure 5:
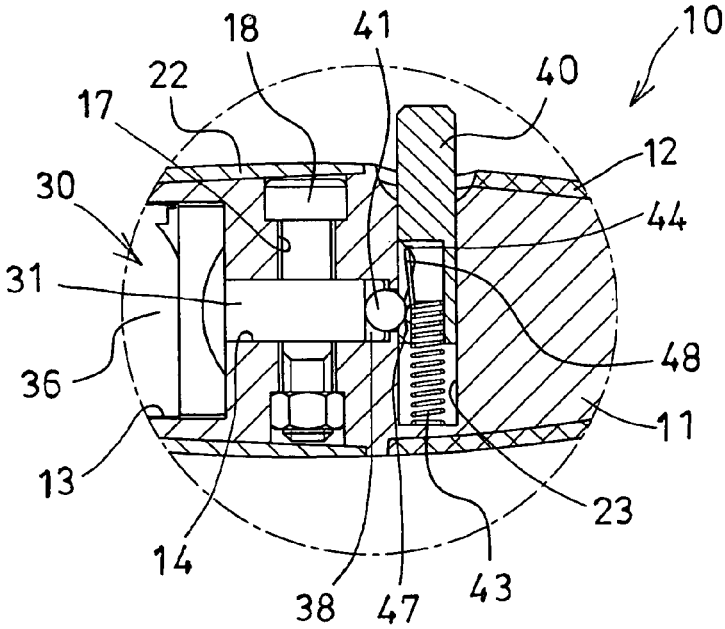
FIG. 5 is another partial cross sectional view of the tool device taken along lines 5-5 of FIG. 4.
Figure 6:
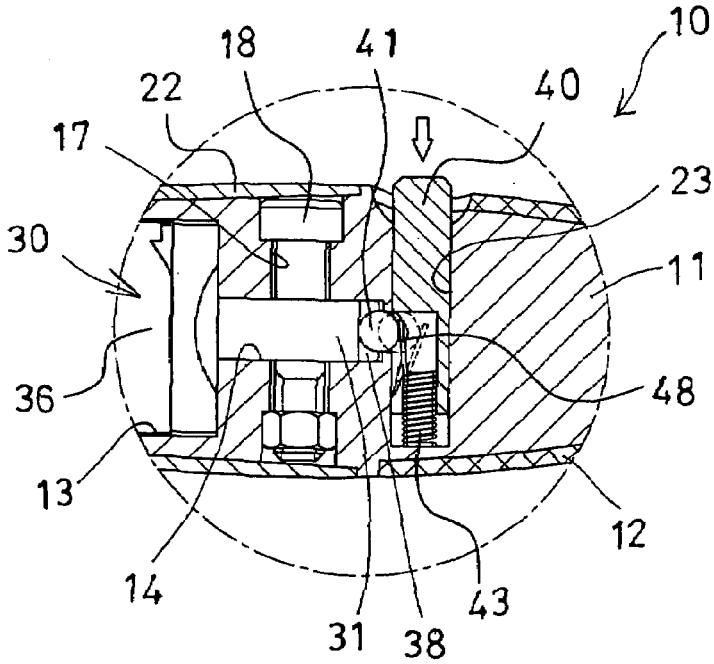
FIG. 6 is a partial cross sectional view similar to FIG. 5, illustrating the operation of the tool device.

In operation, as shown in FIG. 5, the spring member 43 may bias the actuating member 40 to move relative to the handle 11 and to force the actuating portion 47 of the actuating member 40 to engage with the detent member 41 and thus to force the detent member 41 to engage into or with either of the depressions 38 of the driving shank 30 in order to position or secure the driving shank 30 to the handle 11 at any selected angular position. As shown in FIG. 6, when the actuating member 40 is depressed into the pathway 23 of the handle 11 against the spring member 43, the actuating portion 47 of the actuating member 40 may be disengaged from the detent member 41, and the detent member 41 may be selectively aligned with and received in the deeper middle portion 46 of the actuating member 40 and thus for allowing the driving shank 30 to be rotated relative to the handle 11 to any selected angular position.

When the actuating member 40 is released, the spring member 43 may bias the actuating portion 47 of the actuating member 40 to engage with the detent member 41 and thus to force the detent member 41 to engage into or with the other depressions 38 of the driving shank 30 in order to position or secure the driving shank 30 to the handle 11 at any other selected angular position. The handle 11 may further include a number of cavities 25 in the other end portion 26 thereof for receiving various spare tool members 80, such as screw driver bits 80 therein, and a cover 27 selectively attached onto the other end portion 26 thereof for enclosing the cavities 25 of the handle 11 and for stably retaining the spare tool members 80 in the cavities 25 of the handle 11.

Alternatively, as shown in FIG. 8, the actuating device 4 may include a slidable knob 50 slidably engaged in the handle 11 and having an actuating element 51 for being biased to engage into or with either of the depressions 38 of the one end 31 of the driving shank 30 by a spring member 52. The driving shank 30 may include a magnetic attracting member 39 engaged in the socket opening 33 of the driving shank 30 for attracting the tool members 8 to the driving shank 30. Further alternatively, as shown in FIG. 9, the driving shank 30 may include a spring biased retaining device 60 for detachably anchoring or coupling the tool members 8 to the driving shank 30.

Accordingly, the tool device in accordance with the present invention includes a driving shank rotatably attached to a handle and rotatable relative to the handle to a straight position in line with the handle to form a typical screw driving tool or rotatable relative to the handle to an inclined position or a perpendicular position relative to the handle to form a T-shaped driving tool for allowing the tool device to be worked in different working positions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool device comprising:

a handle and including a chamber formed therein and including a passage formed therein and communicating with said chamber of said handle, and a driving shank including a first end engaged into said handle and rotatably attached and coupled to said handle with a pivot shaft for allowing said driving shank to be rotated relative to said handle, said driving shank being rotated relative to said handle from a straight position in line with said handle to a position perpendicular to said handle to form a T-shaped driving tool device, said driving shank being received in said passage of said handle when said driving shank is in line with said handle, and said handle including a spring member engaged between said first end of said driving shank and said handle for biasing said driving shank against said handle and for positioning said driving shank to said handle.

2. The tool device as claimed in claim 1, wherein said driving shank includes a plurality of depressions formed therein, and said handle includes a spring biased detent member for engaging with either of said depressions of said driving shank and for anchoring said driving shank to said handle at selected angular positions.

3. The tool device as claimed in claim 2, wherein said depressions of said driving shank are formed in an outer peripheral portion of said first end of said driving shank.

4. The tool device as claimed in claim 2, wherein said handle includes a channel formed therein for receiving said first end of said driving shank and includes a conduit formed therein for receiving said spring biased detent member.

5. The tool device as claimed in claim 1, wherein said handle includes an orifice formed therein for receiving said pivot shaft.

6. The tool device as claimed in claim 1, wherein said handle includes at least one catch extended into said passage of said handle for engaging with said driving shank and for anchoring said driving shank to said handle.

7. The tool device as claimed in claim 1, wherein said handle includes a plurality of cavities in an end portion thereof for receiving spare tool members therein, and a cover attached onto said handle for enclosing said cavities of said handle and for stably retaining said spare tool members in said cavities of said handle.

8. A tool device comprising:

a handle and including a chamber formed therein and including a passage formed therein and communicating with said chamber of said handle, and a driving shank including a first end engaged into said handle and rotatably attached and coupled to said handle with a pivot shaft for allowing said driving shank to be rotated relative to said handle, said driving shank being rotated relative to said handle from a straight position in line with said handle to a position perpendicular to said handle to form a T-shaped driving tool device, said driving shank being received in said passage of said handle when said driving shank is in line with said handle, said driving shank including a plurality of depressions formed therein, and said handle including a spring biased detent member for engaging with either of said depressions of said driving shank and for anchoring said driving shank to said handle at selected angular positions, said handle including a channel formed therein for receiving said first end of said driving shank and including a conduit formed therein for receiving said spring biased detent member, and said handle including a pathway formed therein and communicating with said conduit of said handle, an actuating member slidably received in said pathway of said handle and engaged with said spring biased detent member for biasing said spring biased detent member to engage with either of said depressions of said driving shank.

9. The tool device as claimed in claim 8, wherein said actuating member includes a recess formed in an outer peripheral portion thereof for receiving said spring biased detent member therein, said recess of said actuating member includes a deeper middle portion for receiving said spring biased detent member and for allowing said detent member to be disengaged from said first end of said driving shank and for allowing said driving shank to be rotated relative to said handle.

10. The tool device as claimed in claim 9, wherein said recess of said actuating member includes a shallower actuating portion for engaging with said spring biased detent member and for forcing said spring biased detent member to engage with either of said depressions of said driving shank.

11. The tool device as claimed in claim 9, wherein said actuating member includes a bore formed therein and communicating with said recess of said actuating member for forming a slot between said bore and said recess of said actuating member.

12. The tool device as claimed in claim 11, wherein said handle includes a spring member received in said pathway of said handle for biasing said handle to engage with said detent member.

13. The tool device as claimed in claim 12, wherein said spring member includes a biasing segment extendible into said recess of said actuating member through said slot of said actuating member for engaging with said detent member and for forcing said detent member to engage with either of said depressions of said driving shank.

14. A tool device comprising:

a handle and including a chamber formed therein and including a passage formed therein and communicating with said chamber of said handle, and a driving shank including a first end engaged into said handle and rotatable attached and coupled to said handle with a pivot shaft for allowing said driving shank to be rotated relative to said handle, said driving shank being rotated relative to said handle from a straight position in line with said handle to a position perpendicular to said handle to form a T-shaped driving tool device, said driving shank being received in said passage of said handle when said driving shank is in line with said handle, and said handle including an orifice formed therein for receiving said pivot shaft, and said handle including an enclosing cap attached thereto to enclose said orifice of said handle and to shield said pivot shaft.

15. A tool device comprising:

a handle and including a chamber formed therein and including a passage formed therein and communicating with said chamber of said handle, and a driving shank including a first end engaged into said handle and rotatably attached and coupled to said handle with a pivot shaft for allowing said driving shank to be rotated relative to said handle, said driving shank being rotated relative to said handle from a straight position in line with said handle to a position perpendicular to said handle to form a T-shaped driving tool device, said driving shank being received in said passage of said handle when said driving shank is in line with said handle, and said handle including at least one latch flap extended from said first end of said handle for partially enclosing said passage of said handle and for retaining said driving shank in said passage of said handle and for allowing said driving shank to be engaged into or out of said passage of said handle.

* * * * *